US011506344B2

(12) United States Patent
Kato et al.

(10) Patent No.: US 11,506,344 B2
(45) Date of Patent: Nov. 22, 2022

(54) LIGHT-EMITTING DEVICE AND LIGHT-EMITTING DEVICE SET

(71) Applicant: Sharp Fukuyama Laser Co., Ltd., Fukuyama (JP)

(72) Inventors: Masahiro Kato, Fukuyama (JP); Masaya Ishida, Fukuyama (JP); Hiroyoshi Higashisaka, Fukuyama (JP); Hiroki Orita, Fukuyama (JP); Tsuyoshi Ono, Fukuyama (JP)

(73) Assignee: Sharp Fukuyama Laser Co., Ltd., Fukuyama (JP)

( * ) Notice: Subject to any disclaimer, the term of this patent is extended or adjusted under 35 U.S.C. 154(b) by 0 days.

(21) Appl. No.: 17/377,158

(22) Filed: Jul. 15, 2021

(65) Prior Publication Data

US 2022/0042654 A1 Feb. 10, 2022

(30) Foreign Application Priority Data

Aug. 5, 2020 (JP) ..... JP2020-133054

(51) Int. Cl.
*F21K 9/20* (2016.01)
*F21V 31/00* (2006.01)
*F21V 19/00* (2006.01)

(52) U.S. Cl.
CPC ..... *F21K 9/20* (2016.08); *F21V 19/0015* (2013.01); *F21V 31/005* (2013.01)

(58) Field of Classification Search
CPC ..... F21K 9/20; F21V 19/0015; F21V 31/005; F21V 19/0055; F21V 27/02; F21V 5/007; F21V 29/70; F21Y 2115/30
See application file for complete search history.

(56) References Cited

U.S. PATENT DOCUMENTS 8,714,771 B2 * 5/2014 Nishimori ..... F21V 17/10 362/225
8,899,784 B2 * 12/2014 Meyer ..... G09F 13/28 362/240
10,649,130 B2 * 5/2020 Franck ..... G02B 6/0096
10,795,248 B2 * 10/2020 Shimizu ..... H01S 5/02208
10,826,277 B2 * 11/2020 Horn ..... F21K 9/64
2011/0114977 A1 * 5/2011 Miura ..... F21V 27/02 257/E33.056
2013/0033851 A1 * 2/2013 Wang ..... F21V 19/0055 362/101
2013/0194799 A1 * 8/2013 Wu ..... F21K 9/60 362/240
2014/0168991 A1 * 6/2014 Kim ..... F21V 17/02 362/297

(Continued)

FOREIGN PATENT DOCUMENTS

JP 5435854 B2 3/2014

*Primary Examiner* — Tsion Tumebo
(74) *Attorney, Agent, or Firm* — ScienBiziP, P.C.

(57) ABSTRACT

A light-emitting device comprises a casing including an upper surface portion having one or more first through holes, and a front surface portion having an opening; a transparent member that closes off the one or more first through holes; one or more light-emitting elements that face the one or more first through holes, respectively, within the casing; and a lid member provided so as to close off the opening, wherein the casing is integrally formed using one material.

13 Claims, 7 Drawing Sheets

(56) References Cited

U.S. PATENT DOCUMENTS

| | | | | |
|---|---|---|---|---|
| 2015/0146431 | A1* | 5/2015 | Kwak | F21V 17/104<br>362/294 |
| 2017/0138583 | A1* | 5/2017 | Ito | F21V 29/80 |
| 2017/0317467 | A1* | 11/2017 | Miura | H01S 5/02253 |
| 2017/0338628 | A1* | 11/2017 | Matsushita | H01L 33/62 |
| 2018/0017217 | A1* | 1/2018 | Doubek | F21V 29/70 |

* cited by examiner

LIGHT-EMITTING DEVICE AND LIGHT-EMITTING DEVICE SET

BACKGROUND

1. Field

The present disclosure relates to a light-emitting device and to a light-emitting device set.

2. Description of the Related Art

Light-emitting devices on which light-emitting elements such as laser diodes or the like are mounted are being developed in recent years, as disclosed in Japanese Patent No. 5,435,854. In such light-emitting devices, a plate-like seat and a sealing cap having a recessed shape are fixed to each other, thereby forming an inner space. A light-emitting element is provided in this inner space. A through hole is provided in an upper surface portion of the sealing cap. Light emitted by the light-emitting element travels to the external space through the through hole.

According to one above-described light-emitting device, the seat and the sealing cap are connected by welding or the like. Accordingly, a connected portion is formed between the seat and the sealing cap. As a result, heat is not readily conducted to the entirety of the seat and the sealing cap. Accordingly, thermal dissipation of the light-emitting element is not good.

The present disclosure provides a light-emitting device and a light emitting device set with improved thermal dissipation.

SUMMARY

A light-emitting device according to one aspect of the present disclosure includes a casing including an upper surface portion having one or more first through holes and a front surface portion having an opening, a transparent member that closes off the one or more first through holes, one or more light-emitting elements that face the one or more first through holes, respectively, within the casing, and a lid member provided so as to close off the opening. The casing is integrally formed using one material.

A light-emitting device set according to another aspect of the present disclosure includes multiple light-emitting devices, each of which is the above-described light-emitting device, and a frame member that binds the multiple light-emitting devices into one assembly.

A light-emitting device set according to another aspect of the present disclosure includes multiple light-emitting devices, each of which is the above-described light-emitting device. One of two adjacent light-emitting devices out of the multiple light-emitting devices includes a connecting portion, and an other of two adjacent light-emitting devices out of the multiple light-emitting devices includes a connection-accepting portion connected to the connecting portion.

DESCRIPTION OF THE EMBODIMENTS

Figure 1:
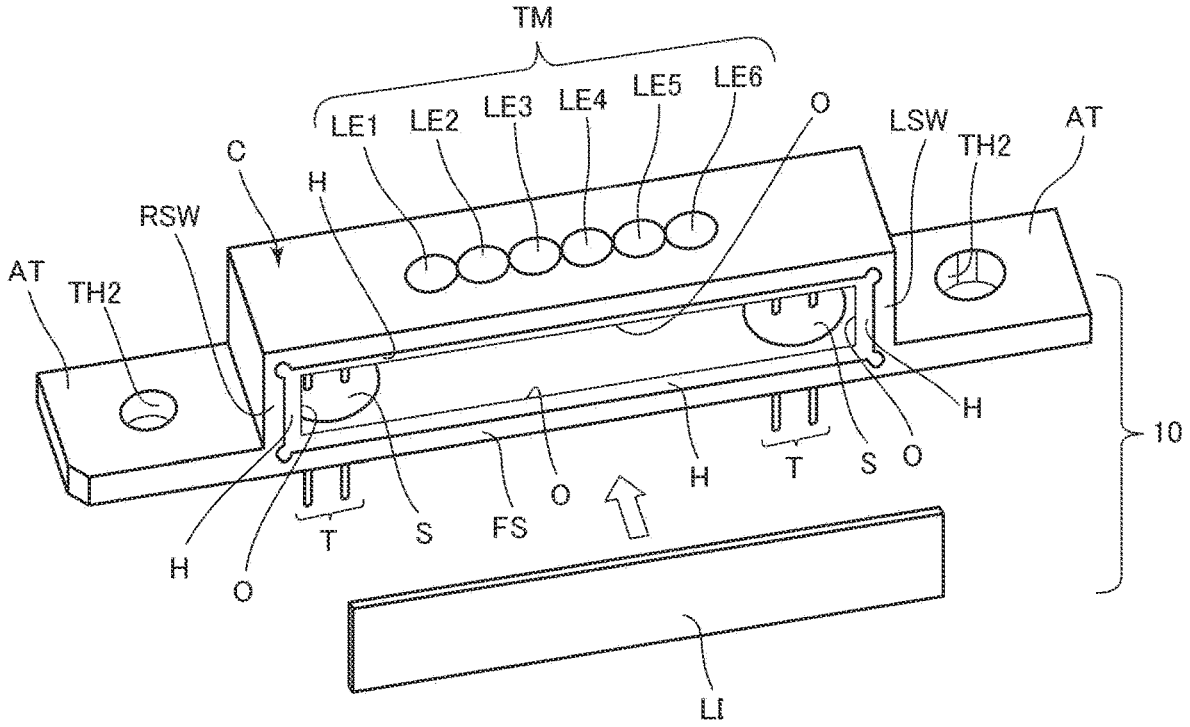
FIG. 1 is an exploded perspective view of a light-emitting device according to Embodiment 1.

Light-emitting devices and light-emitting device sets according to embodiments of the present disclosure will he described below with reference to the drawings. Note that in the drawings, components that are the same or equivalent are denoted by the same symbols. Redundant description of components denoted by the same symbols will not be repeated in the description of the drawings, unless particularly expedient.

Embodiment 1

A light-emitting device 10 according to Embodiment 1 will be described with reference to FIGS. 1 through 6.

FIG. 1 is an exploded perspective view of the light-emitting device 10 according to Embodiment 1. The light-emitting device 10 is provided with a casing C, attaching portions AT, a lid member LI, wiring T, sealing members 5, and a transparent member TM, as illustrated in FIG. 1. FIG. 1 illustrates a state in which only the lid member LI is removed from the casing C, and the wiring T, the sealing members 5, and the transparent member TM are attached to the casing C. Light-emitting elements are hidden inside the casing C in FIG. 1.

The casing C has a cuboid shape. Note, however, that the shape of the casing C does not have to be a cuboid shape in a strictly geometrical sense, and the corners may be rounded or chamfered. Also, the shape of the casing C is not limited to a cuboid shape. The casing C may have any shape, such as a cylindrical shape, a conical shape, or the like, as long as the shape enables the casing C to encompass one or more light-emitting elements LD (not illustrated in FIG. 1), and enables the light-emitting device 10 to exhibit the functions thereof.

The attaching portions AT each have a flange-like shape in which a lower surface portion of the cuboid is extended to each of a side of a left side surface and a side of a right side surface. The attaching portions AT may be parts used for attaching the light-emitting device 10 to another member.

The casing C and the attaching portions AT may be integrally formed from the same material. In the present embodiment, the casing C and the attaching portions AT are formed of a single material, such as copper alone, for example. Accordingly, the casing C and the attaching portions AT have no portions where the same or different materials are bonded or welded to each other, which could become thermal resistance sources. Thus, the thermal conductivity of the entire casing C and attaching portion AT is good.

The lid member LI and the casing C may be joined by methods such as ultrasonic welding or heat welding, by bonding using an adhesive agent, or the like in the present embodiment.

Figure 2:
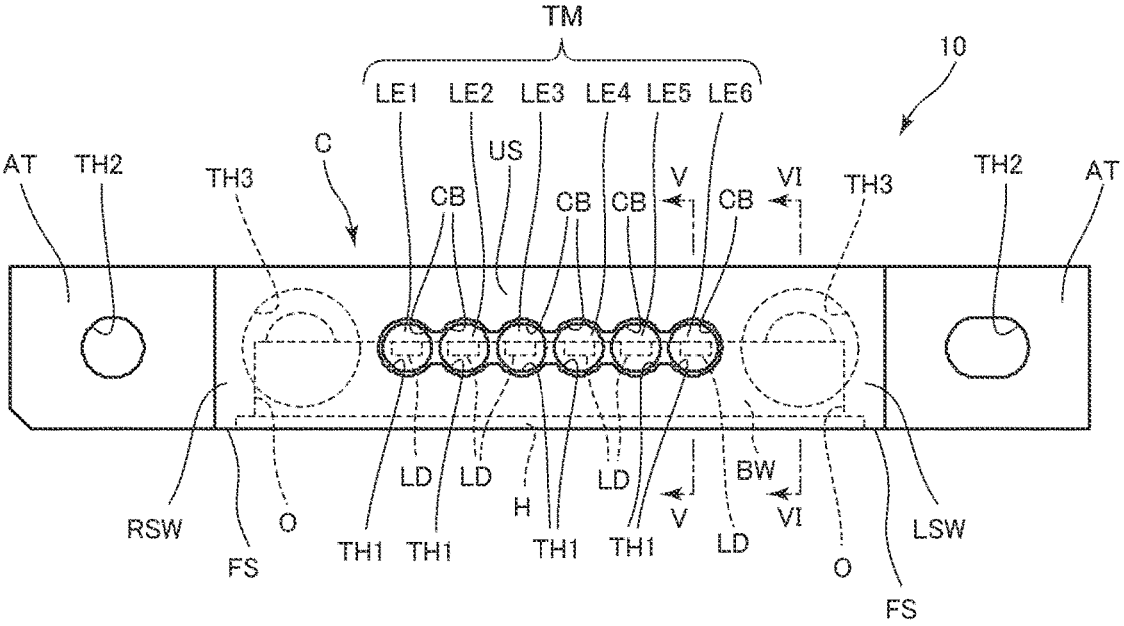
FIG. 2 is a top view of a casing to which light-emitting elements are attached in the light-emitting device according to Embodiment 1.

FIG. 2 is a top view of the light-emitting device 10 according to Embodiment 1. The casing C of the light-emitting device 10 includes an upper surface portion US, as illustrated in FIG. 2.

The upper surface portion US has one or more first through holes TH1. Although the number of the one or more first through holes TH1 is six in FIG. 2, the number may be any value. The first through holes TH1 form cylindrical spaces.

The upper surface portion US has the transparent member TM provided so as to close off the one or more first through holes TH1. Any sort of member may be used as the transparent member TM, as long as the member transmits light. In the present embodiment, the transparent member TM may include one or more lens portions LE1, LE2, LE3, LE4, LE5, and LE6, respectively corresponding to the one or more first through holes TH1. In the present embodiment, the one or more lens portions LE1, LE2, LE3, LE4, LE5, and LE6 making up the transparent member TM are each provided independently.

Figure 12:
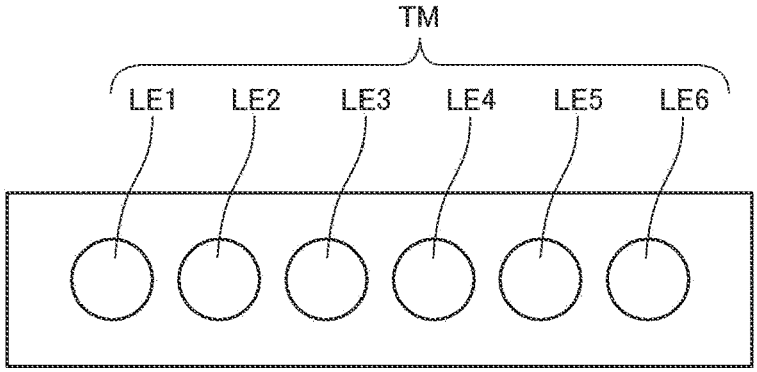
FIG. 12 is a plan view illustrating a transparent member in a light-emitting device according to Embodiment 3.

Note, however, that the entire transparent member TM may be integrally formed (see FIG. 12). This arrangement facilitates attaching of the transparent member TM to the casing C. Also, the transparent member TM may be a plate-like member that has no lens portions and simply transmits light. Note that the lens portions may have a convex lens shape that converges light, or may have a concave lens shape that diverges light.

The casing C may have a protrusion or a counterbore CB around each of the one or more first through holes TH1, for positioning the transparent member TM. The transparent member TM is positioned relative to the casing C by the protrusion or the counterbore CB. Accordingly, attaching the one or more lens portions LE1, LE2, LE3, LE4, LE5, and LE6 to the one or more first through holes TH1 can be easily performed. Light emitted from one or more light-emitting elements LD respectively passes through the one or more lens portions LE1, LE2, LE3, LE4, LE5, and LE6, via the one or more first through holes TH1, and thereafter travels through the external space.

The light-emitting device 10 has the attaching portions AT that protrude from the casing C to the right side and the left side. The attaching portions AT may each have a second through hole TH2 extending in the thickness direction thereof. The second through holes TH2 are for inserting bolts therethrough to attach the light-emitting device 10 to another part. Bolts are an example of an attaching part used to attach the light-emitting device 10 to another part.

The attaching portions AT may have semicircular notches (not illustrated), for example, instead of the second through holes TH2. These also enable the light-emitting device 10 to be attached to another member by bolts or screws, which are examples of the attaching part.

Figure 3:
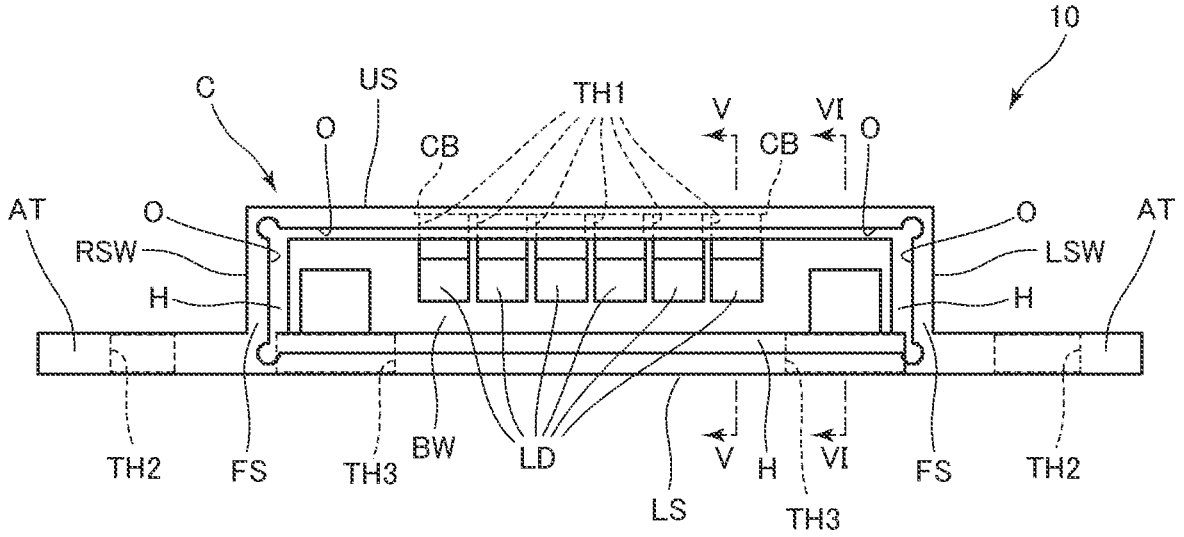
FIG. 3 is a front view of the casing to which the light-emitting elements are attached in the light-emitting device according to Embodiment 1.

FIG. 3 is a front view of the light-emitting device 10 according to Embodiment 1, and is a diagram illustrating a state in which the lid member LI is removed. The casing C has an opening O in a front surface portion FS, as illustrated in FIG. 3. The casing C may have a back wall BW at the deep side from the opening O. As illustrated, one or more light-emitting elements LD may be attached to the back wall BW.

The front surface portion FS of the casing u has a hollow H formed around the outer perimeter of the opening O. The hollow H accommodates the lid member LI. Thus, the lid member LI and the hollow H fit to each other. In the present embodiment, the casing C has the hollow H, and the lid member LI fits into the hollow H (see the outline arrow in FIG. 1).

However, an arrangement may be made in which the lid member LI has a recessed portion, the casing C has a protruding portion, and the protruding portion of the casing C fits into the recessed portion of the lid member LI. The lid member LI and the casing C may have any shape, as long as they have structures that fit to each other.

In the present embodiment, the one or more light-emitting elements LD are multiple edge-emitting semiconductor laser elements. The multiple semiconductor laser elements are arrayed in a row, and are electrically serially connected.

Figure 4:
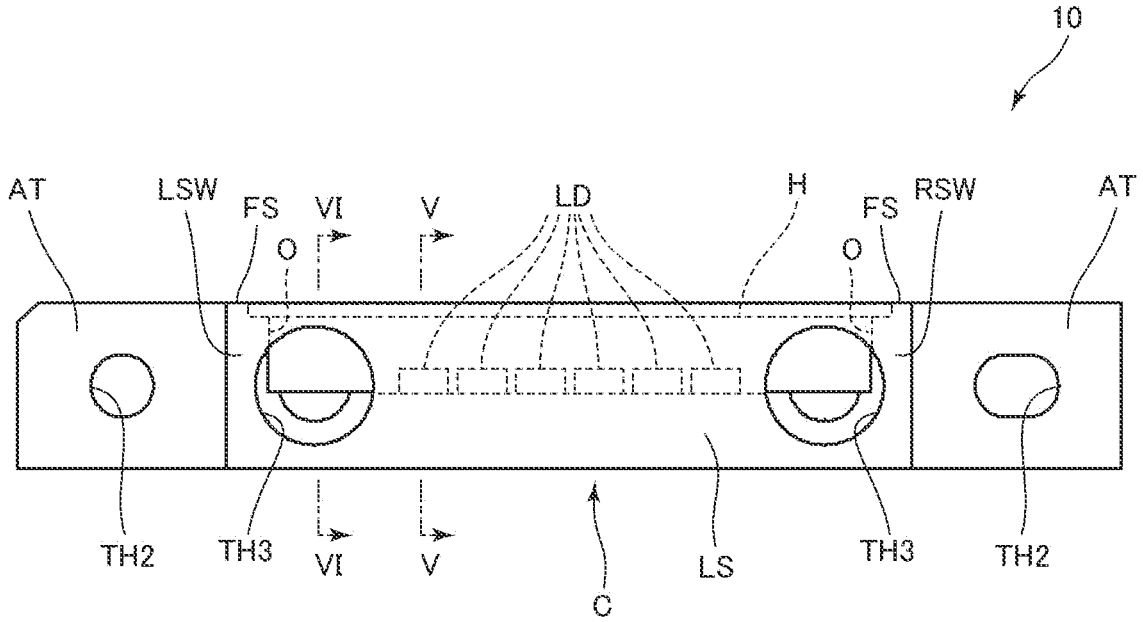
FIG. 4 is a bottom view of the casing to which the light-emitting elements are attached in the light-emitting device according to Embodiment 1.

FIG. 4 is a bottom view of the light-emitting device 10 according to Embodiment 1. The casing C may have two third through holes TH3 in a lower surface portion LS, as illustrated in FIG. 4. Wiring T may be inserted into each of the two third through holes TH3 (see FIG. 1).

The sealing members S fill in the third through holes TH3 through which the wiring T passes. Consequently, the third through holes TH3 may be in a state in which gaps thereof are stopped by the sealing members S.

Figure 5:
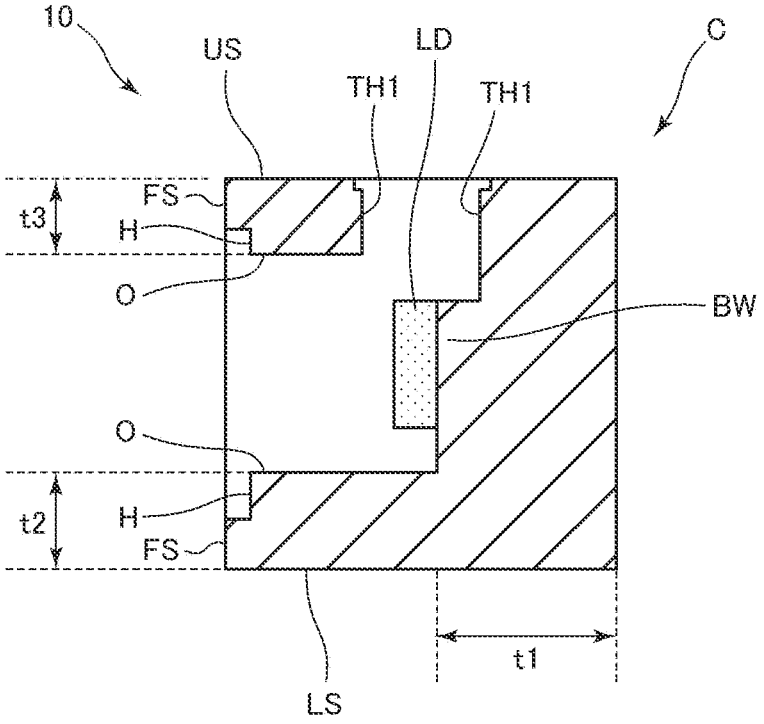
FIG. 5 is a cross-sectional view taken along line V-V in each of FIGS. 2 through 4.

FIG. 5 is a cross-sectional view taken along line V-V in each of FIGS. 2 through 4. The space within the casing C is surrounded by a left side wall LSW, the back wall BW, a right side wall RSW, and the lid member LI, as illustrated in FIG. 5. The space within the casing C contains one or more light-emitting elements LD.

The one or more light-emitting elements LD may be fixed to the back wall BW with an adhesive agent (not illustrated). A thickness t1 of the back wall BW may be not only greater than thicknesses of other portions of the casing, such as a thickness t2 of the lower surface portion LS and a thickness t3 of the upper surface portion US for example, but also may be greater than any of the thickness of the left side wall LSW, the thickness of the right side wall RSW, and the thickness of the lid member LI (see FIGS. 3 and 4).

Figure 6:
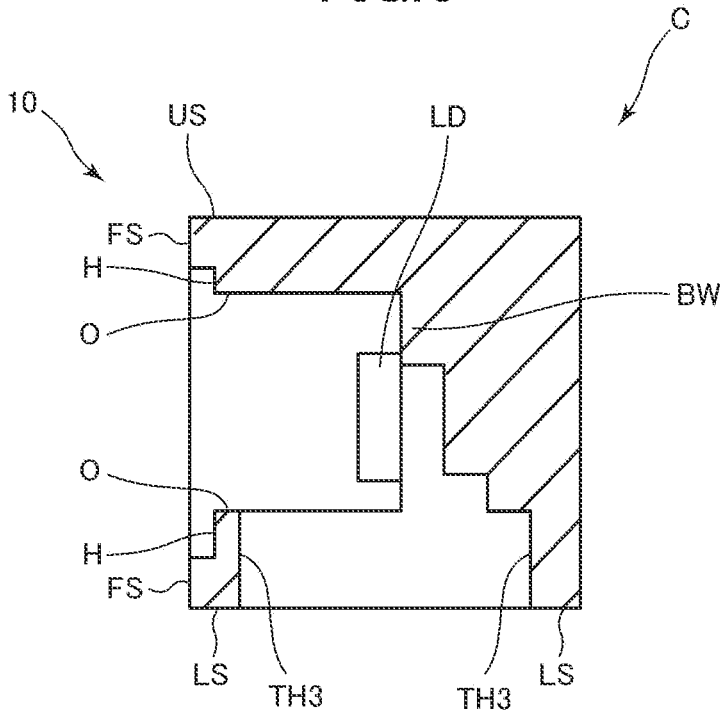
FIG. 6 is a cross-sectional view taken along line VI-VI in each of FIGS. 2 through 4.
Figure 7:
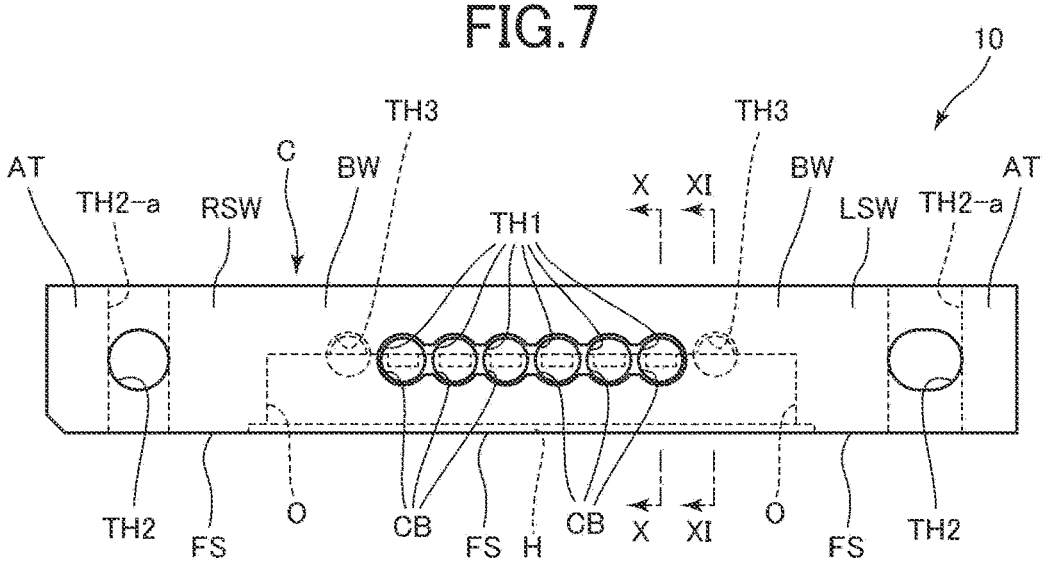
FIG. 7 is a top view of a casing to which light-emitting elements are attached in a light-emitting device according to Embodiment 2.
Figure 8:
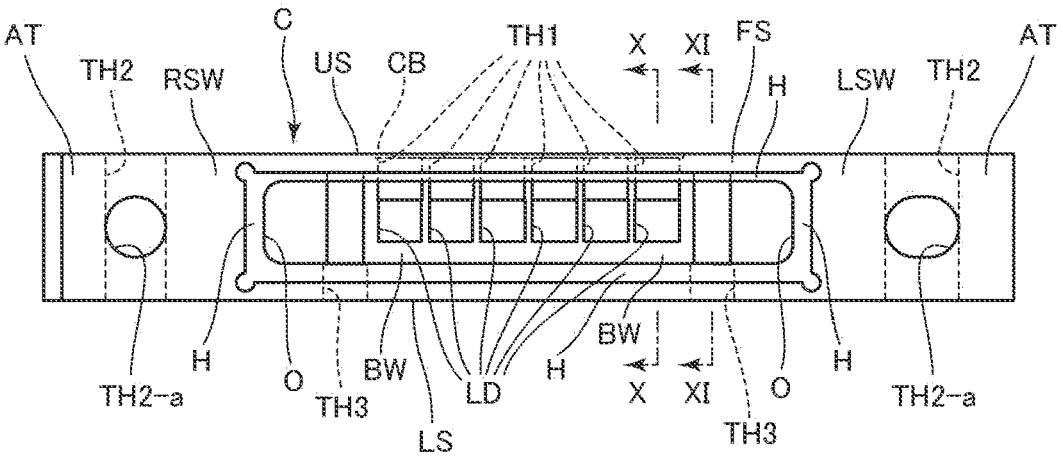
FIG. 8 is a front view of the casing to which the light-emitting elements are attached in the light-emitting device according to Embodiment 2.
Figure 9:
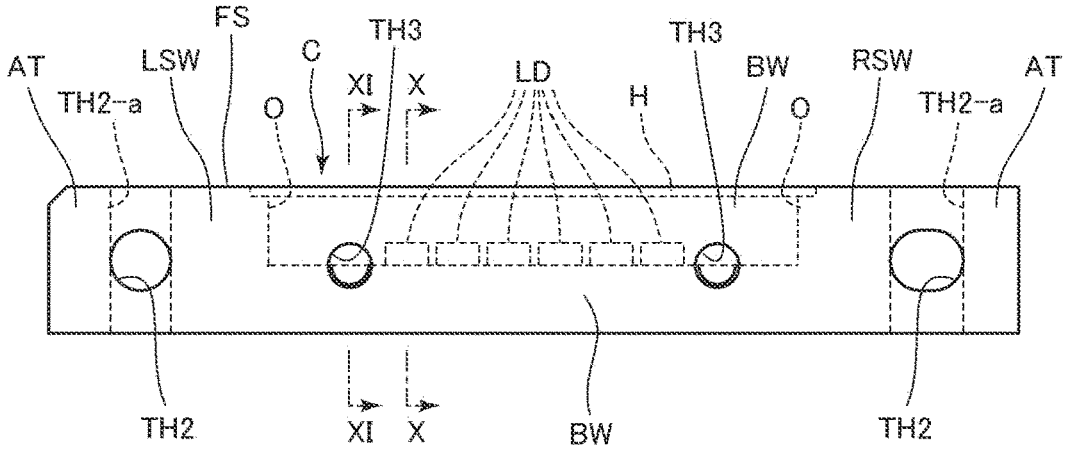
FIG. 9 is a bottom view of the casing to which the light-emitting elements are attached in the light-emitting device according to Embodiment 2.
Figure 10:
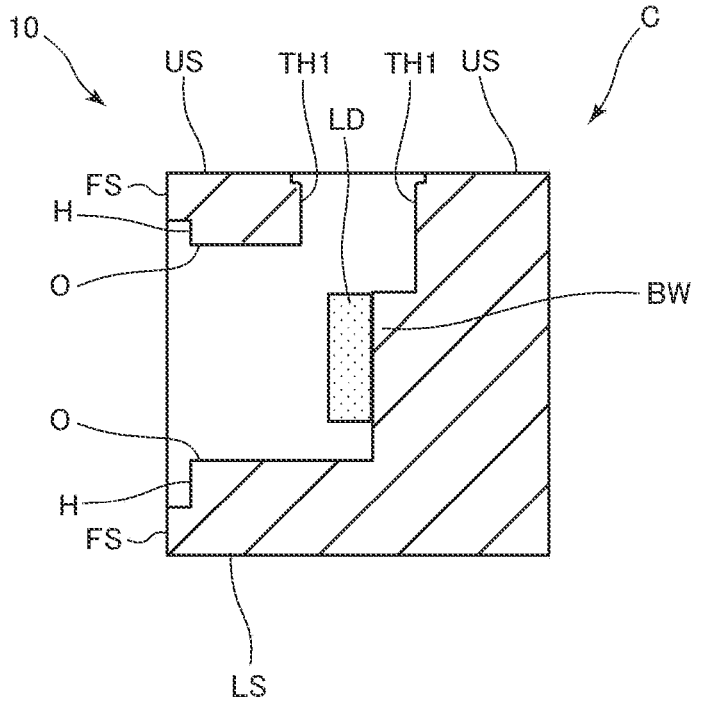
FIG. 10 is a cross-sectional view taken along line X-X in each of FIGS. 7 through 9.
Figure 11:
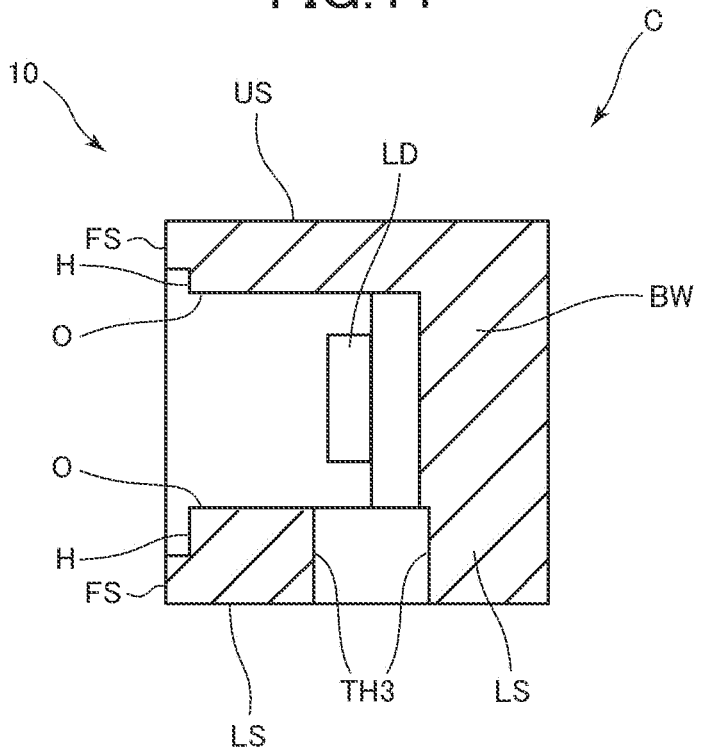
FIG. 11 is a cross-sectional view taken alone line XI-XI in each of FIGS. 7 through 9.

FIG. 6 is a cross-sectional view taken along line VT-VI in each of FIGS. 2 through 4. The space within the casing C is surrounded by the upper surface portion US, the back wall BW, the lower surface portion LS, and the lid member LI (see FIG. 1), which can be understood from FIG. 6.

Before the lid member LI is attached to the casing C, the one or more light-emitting elements LD are each suctioned to a tip of a straw-like member (not illustrated), are inserted from the opening O toward the space within the casing C, and are bonded. The wiring T and the sealing members S are inserted upward into the third through holes TH3 from below.

It can be understood from the above that, regarding the light-emitting device 10 according to the present embodiment, the following can be said, The light-emitting device 10 is provided with the casing C, the transparent member TM, the one or more light-emitting elements LD, and the lid member LI. The casing C includes the upper surface portion US that has the one or more first through holes TH1 and the front surface portion FS that has the opening O. The transparent member TM closes off the one or more first through holes TH1.

The one or more light-emitting elements LD face the one or more first through holes TH1, respectively, within the casing C. The lid member LI is provided on the front surface portion FS so as to close off the opening O. The casing C is formed integrally using one material.

According to this arrangement, the casing C has no portions where the same or different materials are bonded or welded to each other, which could become thermal resistance sources. Accordingly, heat generated from the one or more light-emitting elements LD travels over the entire casing C by thermal conduction. As a result, thermal dissipation of the one or more light-emitting elements LD is improved.

The light-emitting device 10 may have the attaching portions AT. The attaching portions AT may be provided on the outer sides of the casing C. The attaching portions AT may be used for attachment to another part different from the light-emitting device 10. The casing C and the attaching portion AT may be integrally formed using one material.

According to the light-emitting device 10 of the present embodiment, the casing C and the attaching portions AT have no portions where the same or different materials are bonded or welded to each other, which could become thermal resistance sources. Accordingly, heat generated from the one or more light-emitting elements LD travels over the entire casing C and attaching portions AT by thermal conduction. As a result, thermal dissipation of heat emitted from the one or more light-emitting elements LD is improved even further.

The light-emitting device 10 may have the back wall BW. The back wall BW may be provided so as to face the lid member LI. The one or more light-emitting elements LD may be attached to the back wall BW. The thickness of the back wall BW may be greater than the thickness of portions of the casing C different from the back wall BW.

According to this arrangement, heat generated from the one or more light-emitting elements LD first flows to the back wall BW, which has a great volume. Accordingly, heat generated from the one or more light-emitting, elements LD can be transmitted to the casing C more effectively.

The casing C and the lid member LI may have a fit structure in which the positions thereof relative to each other are fixed. According to this arrangement, a gap is not readily formed between the lid member LI and the casing C, and accordingly the space within the casing C is readily sealed off. The fit structure may be a clearance fit, a transition fit, or an interference fit.

The casing C and the lid member LI may be joined by welding or bonding. According to this arrangement, the space within the casing C can be sealed off. The welding may be either ultrasonic welding or heat welding. Any adhesive agent may be used for the bonding.

The transparent member TM may include the one or more lens portions LE1, LE2, LE3, LE4, LE5, and LE6 that respectively face the one or more first through holes TH1. Accordingly, light emitted from the one or more light-emitting elements LD can be converged or diverged.

Forming the one or more lens portions LE1, LE2, LE3, LE4, LE5, and LE6 integrally facilitates installation of the one or more lens portions LE1, LE2, LE3, LE4, LE5, and LE6 to the casing C to close off the one or more first through holes TH1.

The casing C may have a protrusion or counterbore CB around each of the one or more first through holes TH1, for positioning the transparent member TM. Accordingly, positioning of the transparent member TM relative to the casing C can be easily performed.

The transparent member TM and the casing C may be joined by bonding. Accordingly, the space within the casing C can be sealed off. Note that any adhesive agent may be used for the bonding as well.

The casing C may have the one or more third through holes TH3 communicating with inner space thereof. The light-emitting device 10 may be provided with the wiring T and the sealing members S. The wiring T may pass through the one or more third through holes TH3 and may be electrically connected to the one or more light-emitting elements LD. The sealing members S may stop the gaps around the wiring T within the one or more third through holes TH3. Accordingly, the space within the casing C can be brought into a sealed state. The sealing members S may be formed of any material, as long as it is a material that enables the space within the casing C to be brought into a sealed state.

Embodiment 2

A light-emitting device 10 according to Embodiment 2 will be described with reference to FIGS. 7 through 11. Note that in the following, description of points that are the same as in Embodiment 1 will not be repeated. The light-emitting device 10 according to the present embodiment differs from the light-emitting device 10 according to Embodiment 1 with regard to the point that the overall casing C has a substantially cuboid shape. Description will be made below primarily with regard to points of the light-emitting device 10 according to the present embodiment that differ from the light-emitting device 10 according to Embodiment 1.

The light-emitting device 10 according to Embodiment 1 illustrated in FIGS. 1 through 6 and the light-emitting device 10 according to Embodiment 2 illustrated in FIGS. 7 through 11 differ with regard to the configuration of the attaching portions AT, but are approximately the same regarding other configurations, which can be seen by comparing the drawings. Accordingly, thermal dissipation can be improved in the light-emitting device 10 according to the present embodiment, in the same way as in the light-emitting device 10 according to Embodiment 1.

Also, the attaching portions AT of the light-emitting device 10 according to the present embodiment are larger in volume than the flange-like attaching portions AT of the light-emitting device 10 according to Embodiment 1. Accordingly, the casing C and the attaching portions AT can receive a greater amount of heat generated by the one or more light-emitting elements LD. Thus, the light-emitting device 10 according to the present embodiment has thermal dissipation that is further improved as compared to the light-emitting device 10 according to Embodiment 1.

Further, the attaching portions AT have second through holes TH2-*a* besides the second through holes TH2. Accordingly, the light-emitting device 10 can be attached to other parts not only in an up-down direction but also in a front-back direction. Hence, the light-emitting device 10 has a greater variety of forms of attachment.

Embodiment 3

A light-emitting device 10 according to Embodiment 3 will be described with reference to FIG. 12. Note that in the following, description of points that are the same as in Embodiment 1 will not be repeated.

As illustrated in FIG. 12, the light-emitting device 10 according to the present embodiment differs from. the light-emitting devices 10 according to Embodiments 1 and 2 with regard to the points that the multiple lens portions LE1, LE2, LE3, LE4, LE5, and LE6 are integrally formed as a single transparent member TM using the same material. According to the light-emitting device 10 of the present embodiment, the multiple lens portions LE1, LE2, LE3, LE4, LE5, and LE6 can be attached to the casing C at the same time and easily as compared to attaching the multiple lens portions LE1, LE2, LE3, LE4, LE5, and LE6 to the casing C individually.

Note that with the light-emitting device 10 according to the present embodiment, the counterbore CD formed in the upper surface portion US in the proximity of the one or more first through holes TH1 has a rectangular outer shape corresponding to the outer shape of the transparent member TM.

Embodiment 4

Figure 13:
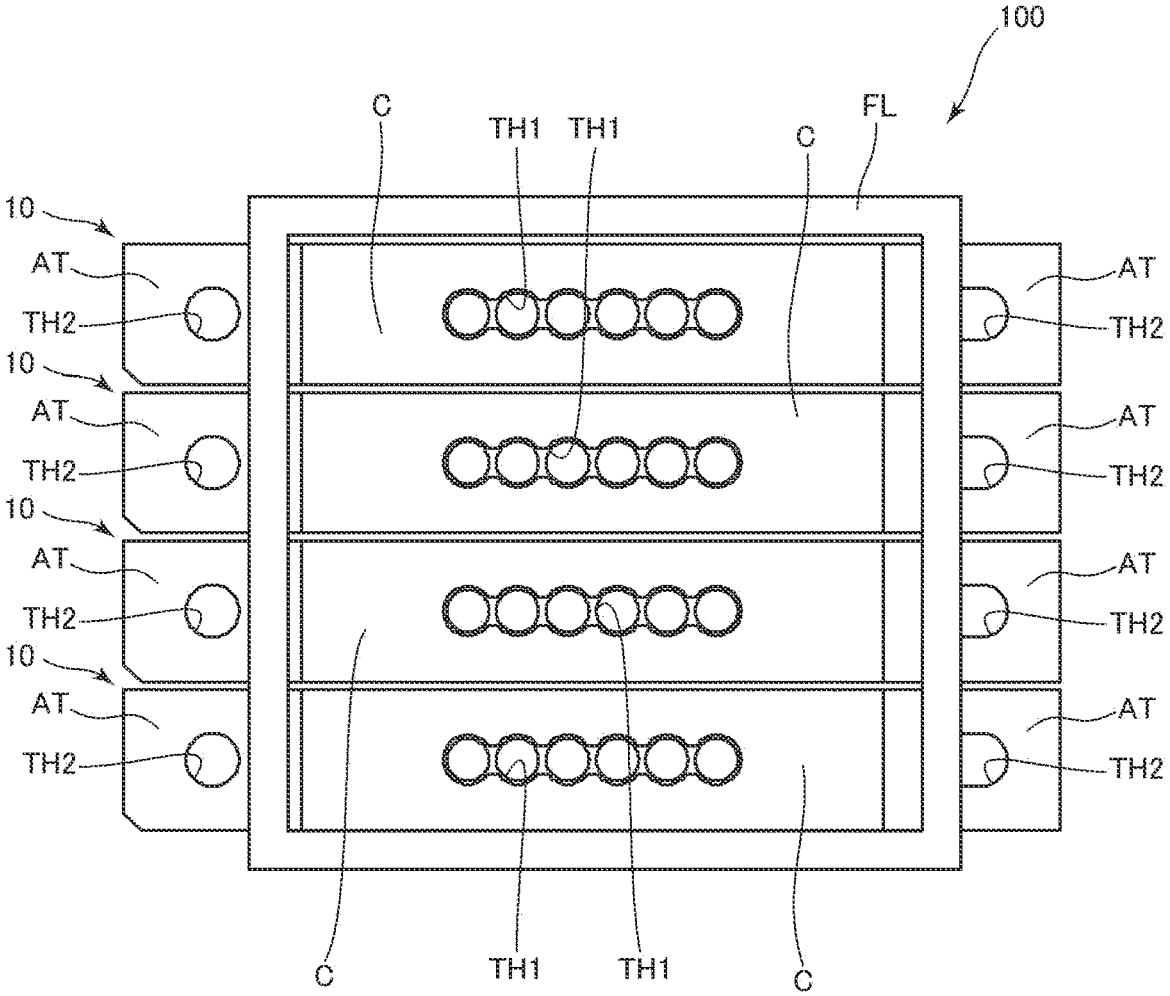
FIG. 13 is a top view of a light-emitting device set according to Embodiment 4.

A light-emitting device set 100 according to Embodiment 4 will be described with reference to FIG. 13. Note that in the following, description of points that are the same as in Embodiments 1 through 3 will not be repeated. The light-emitting device set 100 according to the present embodiment is an arrangement obtained by integrating multiple light-emitting devices 10 according to Embodiment 1.

In other words, the light-emitting device set 100 is provided with multiple light-emitting devices 10, each of which is the light-emitting device 10 according to Embodiment 1, and a frame member FL that binds the multiple light-emitting devices 10 into one assembly. According to this arrangement, multiple light-emitting devices 10 can be easily integrated.

Although the shape of the frame member FL hardly changes in the present embodiment, an arrangement may be made in which the frame member FL exhibits elastic deformation, and the shape thereof changes greatly. Any frame member may be used as long as it is capable of fixing the relative positional relation of the multiple light-emitting devices 10.

Although multiple light-emitting devices 10 according to Embodiment 1 are integrated in the light-emitting device set 100 according to the present embodiment, light-emitting devices 10 according to Embodiment 2 or 3 may be bound and integrated by the frame member FL.

Embodiment 5

A light-emitting device set 100 according to Embodiment 5 will be described with reference to FIG. 14. Note that in the following, description of points that are the same as in Embodiments 1 through 4 will not be repeated. The light-emitting device set 100 according to the present embodiment is an arrangement obtained by integrating multiple light-emitting devices 10 according to Embodiment 1.

Figure 14:
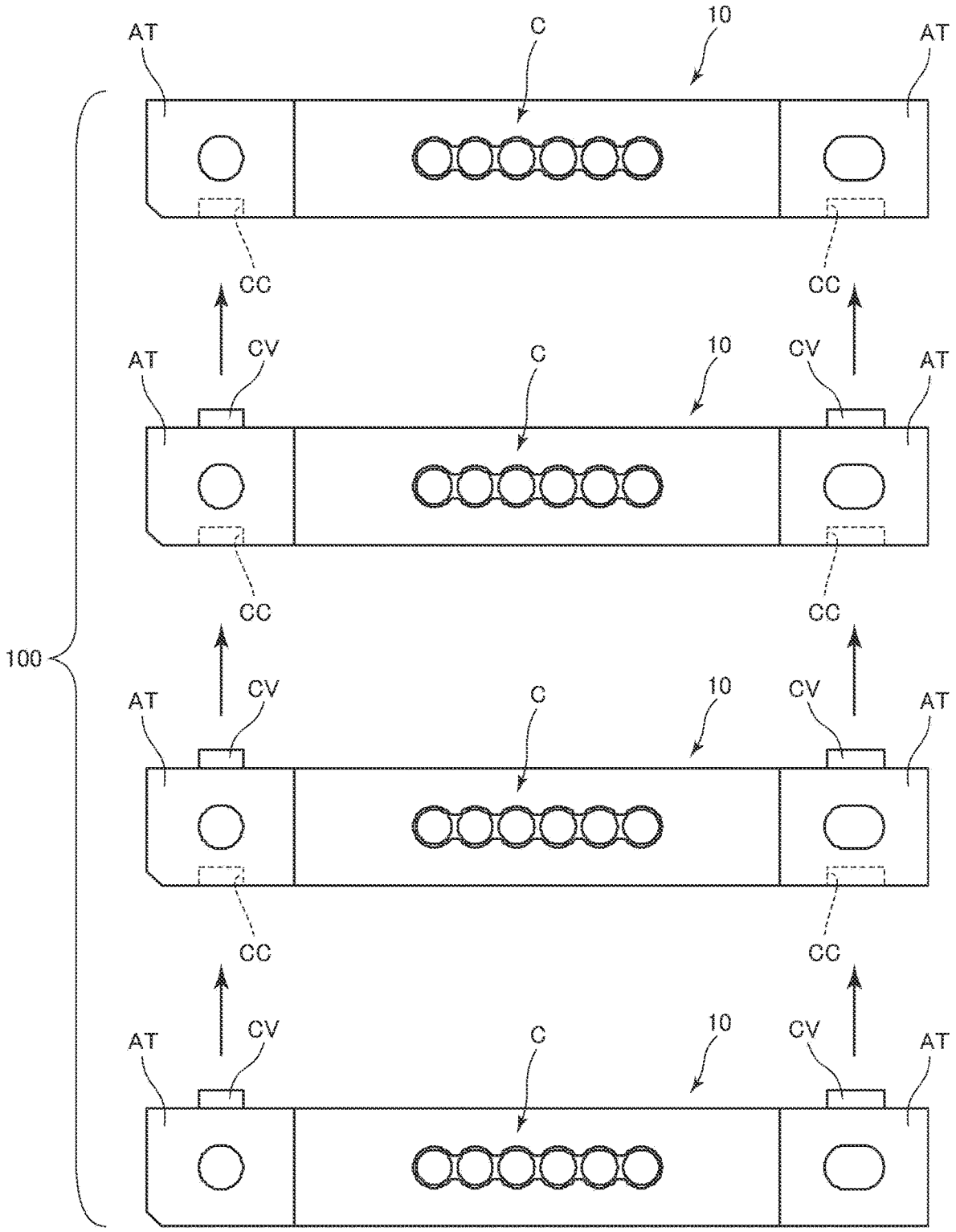
FIG. 14 is an exploded top view of a light-emitting device set according to Embodiment 5.

As illustrated in FIG. 14, in the light-emitting device set 100 according to the present embodiment, each of the light-emitting devices 10 according to Embodiment 1 has connecting portions and connection-accepting portions for integrating the light-emitting devices 10. More specifically, one of two adjacent light-emitting devices 10 of the multiple light-emitting devices 10 includes connecting portions, and the other of the two adjacent light-emitting devices 10 of the multiple light-emitting devices 10 includes connection-accepting portions to be connected to the connecting portions. Thus, integrating multiple light-emitting devices is facilitated.

In the present embodiment, the connecting portions are recessed portions CC, and the connection-accepting portions are protruding portions CV into which the recessed portions CC fit. According to this arrangement, providing a separate manufacturing process for the connecting portions is unnecessary, and accordingly the manufacturing process of the light-emitting devices 10 can be simplified. Note, however, that the connecting portions and the connection-accepting portions are not limited to protrusion-and-recess fit structures. Any structure may be used as long as the light-emitting devices 10 can be integrated and separated to and from each other, such as a snap-fit structure, a retaining structure, or the like.

Also note that the connecting portions such as the recessed portions CC and the connection-accepting portions such as the protruding portions CV of the light-emitting devices 10 according to the present embodiment may be provided on the light-emitting devices 10 according to Embodiments 2 and 3, as well.

The present disclosure contains subject matter related to that disclosed in Japanese Priority Patent Application JP 2020-133054 filed in the Japan Patent Office on Aug. 5, 2020, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A light-emitting device comprising:

a casing including an upper surface portion having one or more first through holes, a back wall that is provided to extend downward from the upper surface portion, and a front surface portion having an opening;

a transparent member that closes off the one or more first through holes;

one or more light-emitting elements that face the one or more first through holes, respectively, within the casing, the one or more light-emitting elements being attached to the back wall; and a lid member provided so as to close off the opening and provided so as to face the back wall, wherein the casing is integrally formed using one material; and a thickness of the back wall is greater than a thickness of a portion of the casing different from the back wall.

2. The light-emitting device according to claim 1, further comprising:

an attaching portion that is provided on an outer side of the casing and that is used for attachment to another part different from the light-emitting device, wherein the casing and the attaching portion are integrally formed using the one material.

3. The light-emitting device according to claim 2, wherein the attaching portion has a second through hole or a notch through which an attaching part used for attachment to the other part is inserted.

4. The light-emitting device according to claim 1,
wherein the casing and the lid member have a fit structure in which a positional relation relative to each other is fixed.

5. The light-emitting device according to claim 1,
wherein the casing and the lid member are joined by welding or bonding.

6. The light-emitting device according to claim 1,
wherein the transparent member includes one or more lens portions that respectively face the one or more first through holes.

7. The light-emitting device according to claim 6,
wherein the one or more lens portions are integrally formed.

8. The light-emitting device according to claim 1,
wherein the casing includes a protrusion or a counterbore around the one or more first through holes, for positioning the transparent member.

9. The light-emitting device according to claim 1,
wherein the transparent member and the casing are joined by bonding.

10. The light-emitting device according to claim 1,
wherein the casing has one or more third through holes, the light-emitting device further comprises:
wiring that passes through the one or more third through holes and that is electrically connected to the one or more light-emitting elements; and
one or more sealing members that stop gaps around the wiring within the one or more third through holes.

11. A light-emitting device set comprising:
a plurality of light-emitting devices, each of which is the light-emitting device according to claim 1; and
a frame member that binds the plurality of light-emitting devices into one assembly.

12. A light-emitting device set comprising:
a plurality of light-emitting devices, each of which is the light-emitting device according to claim 1,
wherein one of two adj acent light-emitting devices out of the plurality of light-emitting devices includes a connecting portion, and
wherein another of the two adjacent light-emitting devices out of the plurality of light-emitting devices includes a connection-accepting portion connected to the connecting portion.

13. The light-emitting device set according to claim 12,
wherein the connecting portion is a recessed portion, and
wherein the connection-accepting portion is a protruding portion into which the recessed portion fits.

* * * * *